US008569643B2

(12) United States Patent
Ames, IV et al.

(10) Patent No.: US 8,569,643 B2
(45) Date of Patent: Oct. 29, 2013

(54) ELECTRICAL SWITCHES AND METHODS

(75) Inventors: Wilbur R. Ames, IV, Lake Stevens, WA (US); Warren Haye Wong, Seattle, WA (US); Raymond D. Zoellick, Bothell, WA (US); Norbert Werner Jauch, Malterdingen (DE); Jim T. Ray, Everett, WA (US)

(73) Assignee: Fluke Corporation, Everett, WA (US)

( * ) Notice: Subject to any disclaimer, the term of this patent is extended or adjusted under 35 U.S.C. 154(b) by 240 days.

(21) Appl. No.: 13/035,769

(22) Filed: Feb. 25, 2011

(65) Prior Publication Data

US 2012/0217146 A1 Aug. 30, 2012

(51) Int. Cl.
*H01H 1/00* (2006.01)

(52) U.S. Cl.
USPC ..... 200/502

(58) Field of Classification Search
USPC ..... 200/502, 5 R, 5 EA, 537, 547, 549, 550, 200/16 E, 178, 51 R, 51.02, 531, 563, 252, 200/241; 439/66, 188
See application file for complete search history.

(56) References Cited

U.S. PATENT DOCUMENTS 4,057,520 A * 11/1977 Schwartz ..... 200/16 D
4,871,885 A 10/1989 Kamada
4,975,547 A * 12/1990 Nakayama et al. ..... 200/5 R
6,841,749 B1 * 1/2005 Radosavljevic et al. ..... 200/550
2004/0020752 A1 2/2004 Chu

FOREIGN PATENT DOCUMENTS

WO WO 2009116364 A1 * 9/2009

OTHER PUBLICATIONS

European Search Report mailed Nov. 21, 2012, issued in European Application No. 11178130.8, filed Aug. 19, 2011.

* cited by examiner

*Primary Examiner* — Edwin A. Leon
*Assistant Examiner* — Anthony R. Jimenez
(74) *Attorney, Agent, or Firm* — Christensen O'Connor Johnson Kindness PLLC

(57) ABSTRACT

Generally described, one or more embodiments of the present disclosure are directed to switch assemblies and methods for switching from one state to another. In some examples, a switch assembly may switch from one electrical contact to another electrical contact by moving a conductive spring or member from a first conductive contact on a printed circuit board (PCB) to a second conductive contact on the PCB. For instance, in one embodiment, a conductive member moves within a slot in the PCB. In another embodiment, a compression force applied to a conductive spring is reduced while the conductive spring moves from a first conductive contact to a second conductive contact.

24 Claims, 6 Drawing Sheets

ELECTRICAL SWITCHES AND METHODS

BACKGROUND

Electrical measurement instruments, such as digital multimeters (DMMs), can often be configured to measure a variety of electrical parameters, such as voltage, current, and resistance. Many DMMs are able to switch between various sets of inputs, with each set of inputs or channels supporting most measurement functions of the DMM. Electrical measurement instruments, therefore, typically include an electrical switch for selecting between the various channels.

In some electrical measurement instruments, an external switch may be installed onto a printed circuit board (PCB) for selecting between channels. In other instruments a PCB of the electrical measurement instrument may be configured to form a switch. In general, such a PCB switch comprises a plurality of contacts on a surface of the PCB and one or more conductive springs configured to make electrical contact with one of the respective plurality of contacts when pressed there against. In order to place the electrical measurement instrument in a first state, at least one of the conductive springs is compressed against a first contact formed on the PCB. In order to place the electrical measurement instrument in a second state, the conductive spring is translated to a second position, which for example, presses the conductive spring in contact with a second contact. As the conductive spring moves across the PCB from the first contact to the second contact, the free end of the conductive spring scrapes along the surface of the first and second contacts as well as the PCB. Thus, in such switches, switching from one state to another state may cause wear to the conductive springs therein due to frictional forces applied to the conductive springs. The wear caused to the end of the conductive spring may also potentially damage the contacts and the PCB.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, a switch assembly is provided. The switch assembly may include a substrate, a sliding plate, at least one conductive component, and an insulative body. The substrate may have at least one first conductive contact. The slide plate may be secured to the substrate and have a contoured surface. The at least one conductive component may be configured to electrically connect with the at least one first conductive contact when the at least one conductive component is in a first position. The insulative body may be configured to hold the at least one conductive component. The insulative body may be moveable along the contoured surface of the slide plate and configured to move the at least one conductive component from the first position to a second position. When the first conductive contact is in the second position, the conductive component is a distance away from the first conductive contact.

In accordance with aspects of the present disclosure, a switch assembly comprising a printed circuit board, a first conductive contact, and an insulative body is provided. The printed circuit board may include at least one slot. The at least one slot may have a first end and a second end. The first conductive contact may be provided at the first end of the at least one slot. The insulative body may include at least one conductive member that is configured to be positioned within the at least one slot and may be moveable within the at least one slot to selectively contact the first conductive contact.

In accordance with aspects of the present disclosure, a method of switching an electrical device from a first state to a second state is provided. The method may include compressing at least one conductive spring on a first respective conductive contact to place the electrical device in the first state. The conductive spring may being held by an insulative body. The method may further include sliding a portion of the insulative body along a contoured surface to move the at least one conductive spring from the first respective conductive contact to a second respective conductive contact. Sliding the portion of the insulative body along the contoured surface may reduce an amount at which the at least one conductive spring is compressed. The method may further include compressing the at least one conductive spring on the second respective conductive contact to place the electrical device in the second state.

In accordance with aspects of the present disclosure, a method of switching an electrical device from a first state to a second state may include moving a conductive member of the electrical device to a first position. The conductive member may be positioned in a slot formed in the printed circuit board. When the conductive member is in the first position, the conductive member electrically couples to a first conductive contact formed at a first end of the slot placing the electrical device in the first state. The method may further include moving the conductive member from the first position away from the first conductor contact to a second position placing the electrical device in the second state.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
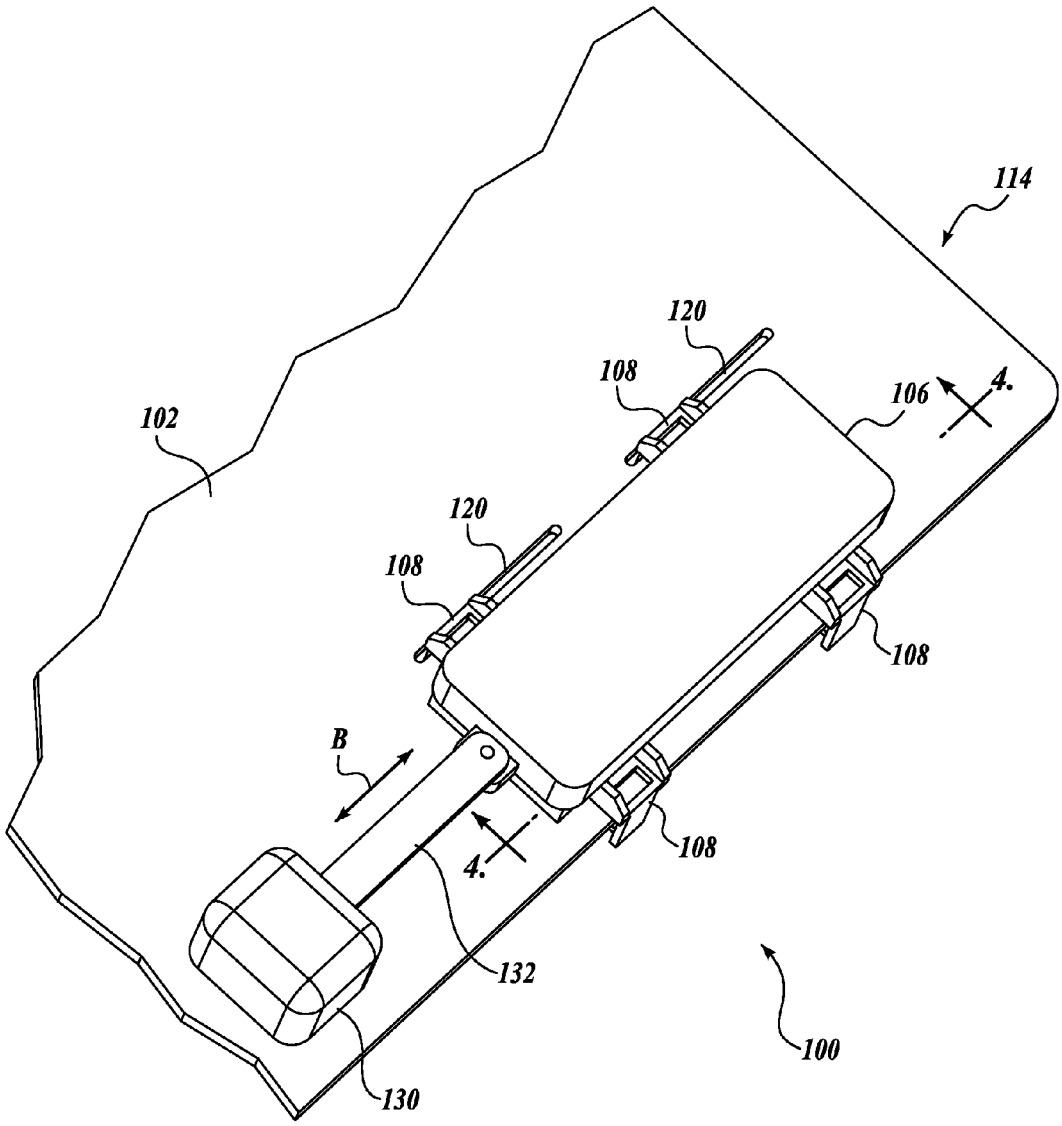
FIG. 1 is a top isometric view of a switch assembly in accordance with aspects of the disclosure.

While illustrative embodiments are illustrated and described below, it will be appreciated that various changes can be made therein without departing from the spirit and scope of the invention. In that regard, the detailed description set forth below, in connection with the appended drawings where like numerals reference like elements, is intended only as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Accordingly, various changes can be made therein without departing from the spirit and scope of the disclosure. Similarly, any steps described herein may be interchangeable with other steps, or combinations of steps, in order to achieve the same or substantially similar result.

The following discussion provides examples of one or more switch assemblies and methods of using the same. Generally described, one or more embodiments of the present disclosure are directed to switch assemblies and methods for switching a switch assembly from one state to another, such as switching from a closed state to an open state and/or vice versa. In some examples, a switch assembly may be configured to switch from one state to another by moving a conductive component, such as such as a spring, bar, member, etc., from a first conductive contact located on a substrate, such as a printed circuit board (PCB), to a second conductive contact located on the substrate. As will be described in more detail below, embodiments of the present disclosure may be configured to reduce wear on the switch assemblies' conductive components, including the conductive component and conductive contacts, as well as associated components of the switch, when moving the conductive component (i.e., switching) from the first conductive contact to the second conductive contact. For instance, in one embodiment, the conductive component, such as a spring, member, rod, bar, etc., moves within a slot in the PCB, thereby eliminating contact between the conductive component and the surface of the PCB. In another embodiment, friction forces and/or other forces applied to the conductive component and/or the PCB are reduced as the conductive component moves across the PCB surface from a first conductive contact to a second conductive contact.

Although the switch assemblies may be shown and described in reference to electrical measurement instruments, it should be appreciated that the methods and assemblies described herein may be used in any electrical device or the like requiring the use of an electrical switch. Furthermore, although the examples illustrated herein are directed to double throw switches, it is to be appreciated that the switch assemblies may apply to any number of throws, including a single throw switch. In examples of single throw switches, the switch assembly may be in a closed state when a conductive spring is in contact with the single conductive contact allowing current to flow therethrough, or in an open state when the conductive spring is separate from the single conductive contact preventing current from flowing therethrough. It will be further appreciated that the electrical switches described herein apply to any number of poles.

Figure 2:
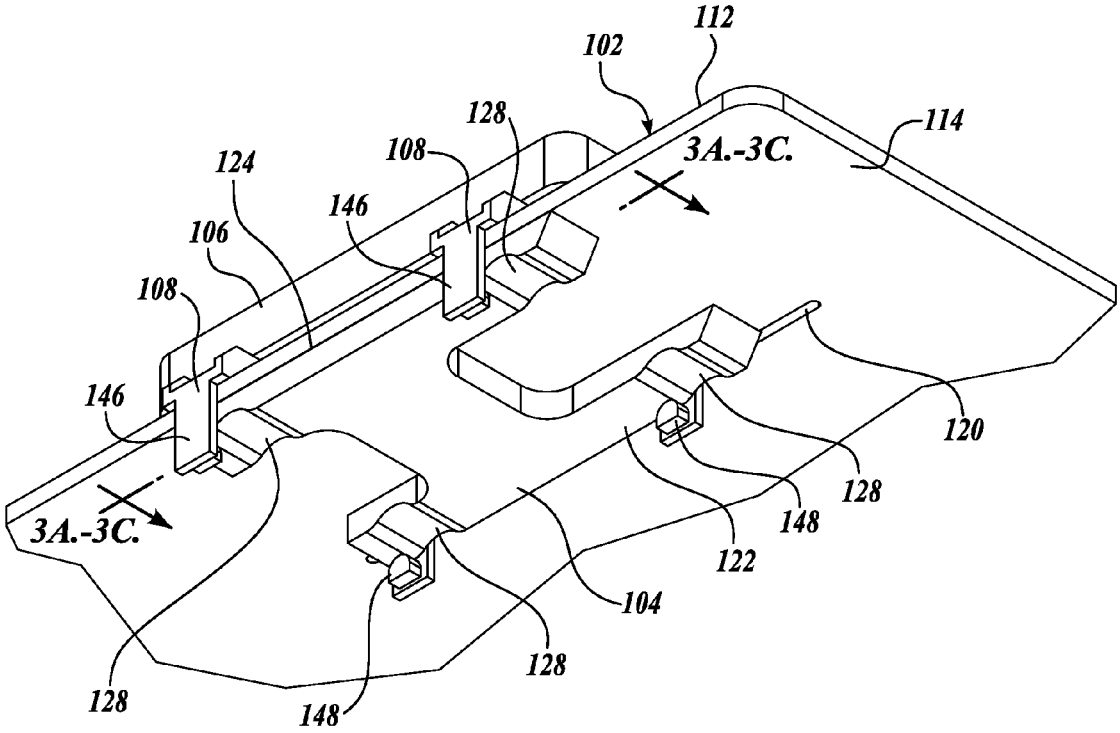
FIG. 2 is a bottom isometric view of the switch assembly of FIG. 1.

Turning now to FIGS. 1 and 2, there are shown top and bottom isometric views of a switch assembly 100 in accordance with aspects of the present disclosure. The switch assembly 100 includes a substrate, such as a PCB 102, a slide plate 104, and an insulative body, such as switch body 106, that is movably retained on the PCB 102, for example, via retaining arms 108. As will be explained in more detail below, the switch body 106 is positioned on the PCB 102 and is configured to move relative to the PCB 102 between a first position, which places the switch assembly 100 in a first state, and a second position, which places the switch assembly 100 in a second state. In that regard, the switch assembly 100 may be configured to switch an associated electrical device between a first electrical state and a second electrical state, such as between a first channel and a second channel.

Figure 3A:
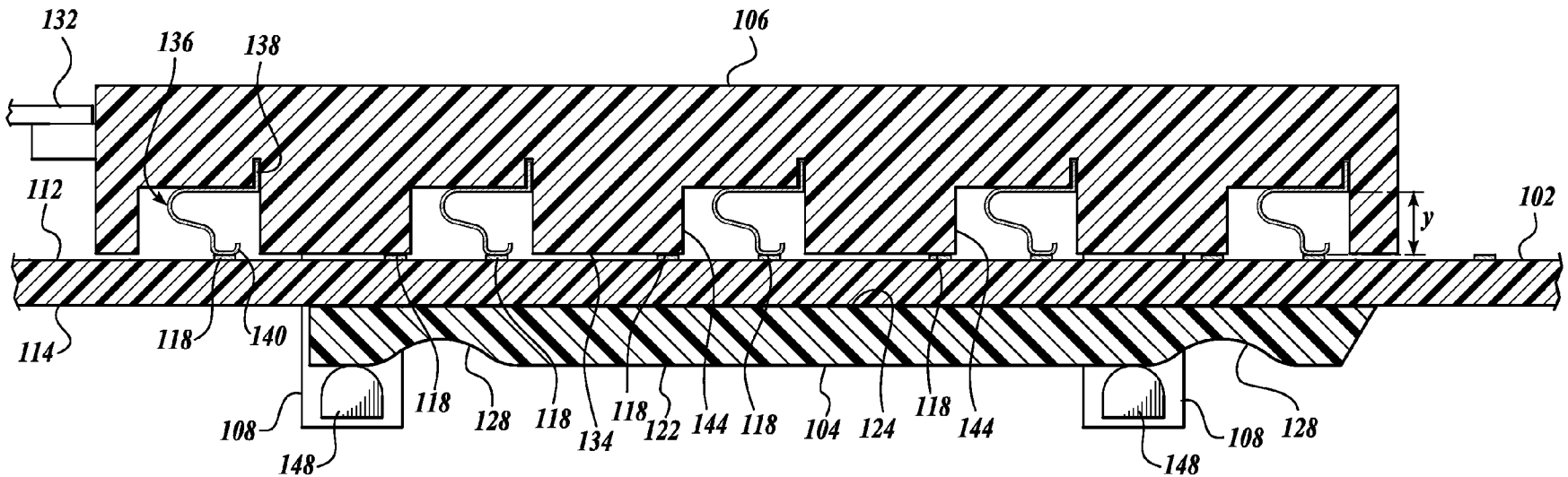
FIG. 3A is a cross-sectional view of the switch assembly of FIG. 2 shown in a first position in accordance with aspects of the disclosure.
Figure 3B:
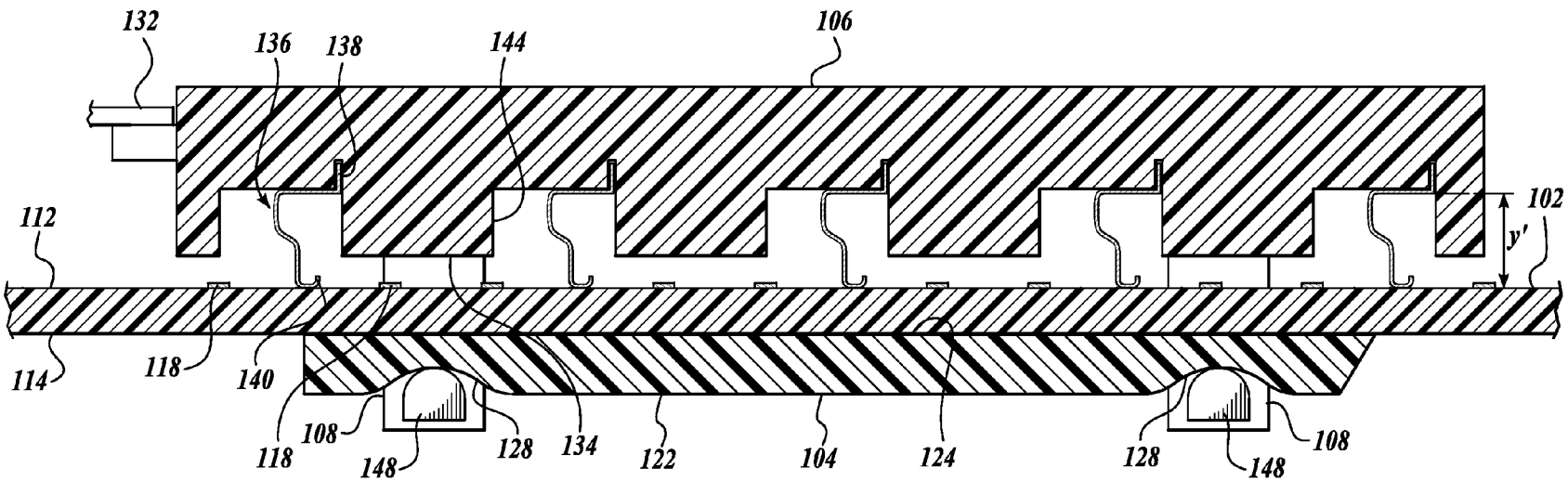
FIG. 3B is a cross-sectional view of the switch assembly of FIG. 3A shown in an intermediate position in accordance with aspects of the disclosure.
Figure 3C:
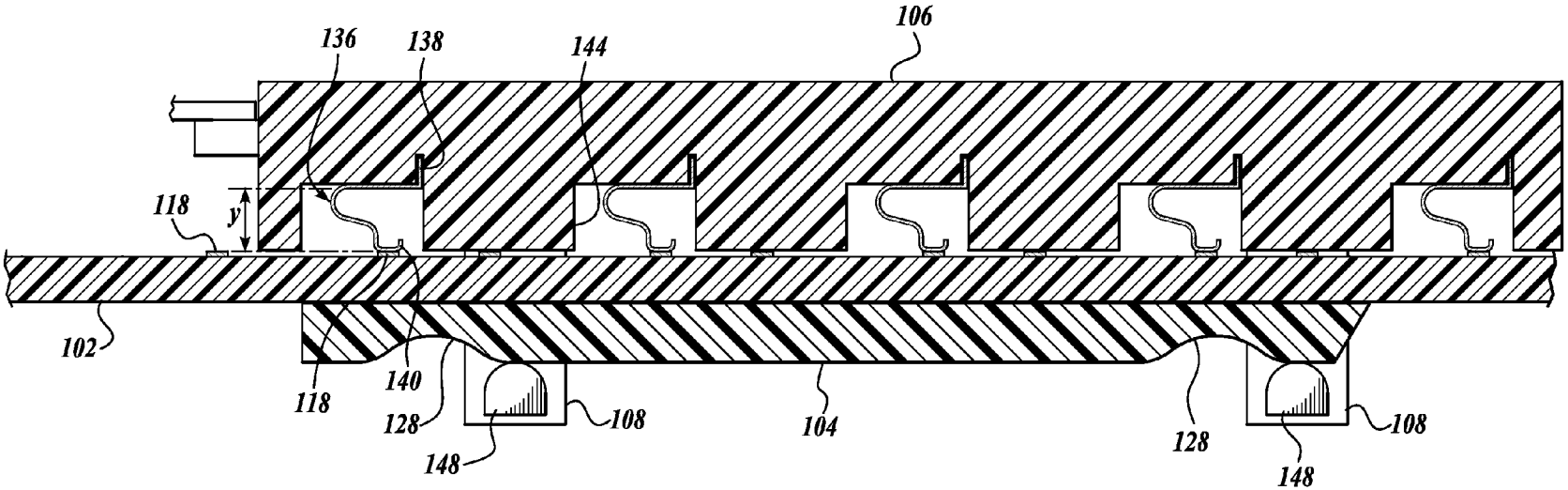
FIG. 3C is a cross-sectional view of the switch assembly of FIG. 3A shown in a second position in accordance with aspects of the disclosure.

As best shown in FIG. 2, the PCB 102 is a somewhat planar member having opposite first and second surfaces 112 and 114. The PCB 102 includes a plurality of conductive contacts 118 secured or otherwise formed on the first surface 112 of the PCB 102, as best illustrated in FIGS. 3A-3C. The conductive contacts 118 may be constructed of any material or materials configured to allow electrons to flow therethrough. In one embodiment, for example, the conductive contacts 118 are constructed out of copper and plated with a noble metal, such as gold. The conductive contacts 118 may be suitably spaced apart from one another so as to electrically isolate each conductive contact 118 from the other conductive contacts 118. It will be appreciated that the conductive contacts 118 may be in electrical communication with other components (not shown) on the PCB 102 via traces (not shown) formed within the PCB 102.

Referring to FIGS. 1 and 2, the PCB 102 may also include one or more elongated openings 120 that extend from the first surface 112 to the second surface 114 of the PCB 102, thereby forming one or more slots. As will be discussed in more detail below, the openings 120 are configured to receive one or more of the retaining arms 108. It will be appreciated that the PCB 102 may be constructed of any material or materials and configured to: 1) mechanically support the components mounted thereon, such as the switch body 106; and 2) electrically isolate the electrical contacts 118 formed thereon. The PCB 102 may constitute a simple circuit of which the switch assembly 100 is a part, or the PCB 102 may be the main and/or sole printed circuit board for the associated electrical device, such as a digital multimeter, that includes the switch assembly 100. In that regard, the PCB 102 may not only form a part of the switch assembly 102, but may also provide connections between and mounting points thereon for other electrical and mechanical components.

The switch assembly 100 further includes a slide plate 104 having first and second surfaces 122 and 124, as best shown in FIGS. 2 and 3A-3C. In the embodiment shown, the second surface 124 of the slide plate 104 interfaces with and may be secured to the second surface 114 of the PCB 102. The first surface 122 of the slide plate 104, on the other hand, may include one or more contours 128, the purpose of which will be described later in more detail.

As briefly described above, the switch body 106 is movable between a first position, such as the position illustrated in FIG. 3A, and a second position, such as the position illustrated in FIG. 3C. To affect movement of the switch body 106, in one embodiment, the switch body 106 is coupled to an actuator 130 via a moving arm 132, as best shown in FIG. 1. In one embodiment, the actuator 130 may be mounted on the PCB 102. In other embodiments, the actuator 130 may be mounted separate from the PCB 102. In either case, the actuator 130 may be configured to move the moving arm 132 in the directions indicated by arrow B, thereby causing the switch body 106 to also move in the directions indicated by arrow B. In other embodiments, the switch body 106 may be manually actuated between the first and second positions. Furthermore, the first and second positions may not necessarily be in a linear relationship to each other.

Returning now to FIGS. 3A-3C, there are shown cross-sectional views of the switch assembly 100, each illustrating the switch assembly in a different position. The switch body 106 defines a somewhat planar surface 134 that may interface with the first surface 112 of the PCB 102, and may be made of an insulative material(s). The switch body 106 may carry one or more conductive components, such as compression springs 136, as it moves between the first position shown in FIG. 3A and the second position shown in FIG. 3C. Each conductive spring 136 includes a first end 138 and a second end 140. Further, each conductive spring 136 is positioned such that the first end 138 of the conductive spring 136 may be secured to the switch body 106 and the second end 140 of the conductive spring 136 extends outwardly from the surface 134 of the switch body 106. The conductive springs 136 may be constructed from any material or materials configured to allow electrons to flow therethrough, and to provide elasticity so as to act like a spring. In one embodiment, the conductive springs 136 are copper with or without noble metal plating.

Each of the conductive springs 136 are positioned within the switch body 106 in a manner that allows the conductive springs 136 to be placed in electrical communication or electrical connection with two adjacent conductive contacts 118 when the switch body 106 is moved to the first or second position. For instance, the second end 140 of each conductive spring 136 may be configured to contact a first respective conductive contact 118 when the switch body 106 is in a first position, such as the position in FIG. 3A, and is configured to contact a second respective conductive contact 118 when the switch body 106 is in a second position, such as the position in FIG. 3C. Although five conductive springs 136 are shown, it is to be understood that any number of conductive springs 136 may be provided depending on the configuration of the switch assembly. In some embodiments, the conductive springs 136 may be compression springs. Non-limiting examples for the conductive springs 136 may include a hanger spring, a leaf spring, a C-shaped spring, or any other spring capable of applying a biasing force against the conductive contacts 118.

The switch body 106 may further include one or more insulative members 144. The insulative members 144 may be positioned between each adjacent conductive spring 136 so as to assist in electrically isolating each conductive spring 136. The insulative members 144 may be formed integral with the switch body 106 as illustrated in FIGS. 3A-3C, or they may be secured thereto.

Returning now to FIGS. 1 and 2, the switch body 106 may include one or more retaining arms 108 secured to or integrally formed with one of the surfaces of the switch body 106 for movably retaining the switch body on the PCB 102, as briefly described above. In the embodiment shown in FIGS. 1 and 2, each of the retaining arms 108 may include an arm portion 146 that extends along the switch assembly 100, such as along an outer edge of the PCB 102 or through one of the openings 120 in the PCB 102. A lip 148 is secured to or integrally formed with the outward end of each arm portion 146. In the embodiment shown, the lip 148 may extend in a direction that is perpendicular to the arm portion 146. As best shown in FIG. 2, the lip 148 of the retaining arms 108 may be configured to engage with first surface 122 of the slide plate 104 in order to hold the switch body 106 on or adjacent the first surface 112 of the PCB 102.

As assembled, the retaining arms 108 hold the switch body 106 on or adjacent the first surface 112 of the PCB 102, while still allowing the switch body 106 to move along the first surface 112 of the PCB 102 between first and second positions. Additionally, the retaining arms 108 are capable of applying a suitable force to slide plate 104 to counteract the biasing force applied to the PCB 102 via the conductive springs 136. In the embodiment shown, the lip 148 of the retaining arms 108 may be configured to slide along the first surface 122 of the slide plate 120. In that regard, each lip 148 of the retaining arms 108 may be configured to slide along a corresponding contour 128 when the switch assembly 100 is moved from a first position to a second position. As each lip 148 slides along a corresponding contour 128, the amount of force applied by the conductive springs 136 on the first surface 112 of the PCB 102 is reduced in relation to the geometry of the contour. This reduction in force applied to the switch body 104 corresponds to a reduction in the amount each conductive spring 136 is compressed.

An example of an operation of switching the switch assembly 100 from a first position as illustrated in FIG. 3A to a second position as illustrated in FIG. 3C will now be described. In the first position illustrated in FIG. 3A, the conductive springs 136 make electrical connection with corresponding conductive contacts 118 formed on the PCB 102. As is illustrated in FIG. 3A, the conductive springs 136 are loaded to a compressed state so as to have a compressed length Y. As such, the compressed conductive springs 136 apply a biasing force to a surface of the corresponding conductive contact 118 for improving the electrical connection therebetween. As described above, the lip 148 of the retaining arms 108 may be configured to counteract the biasing force applied by the conductive spring 136 thereby holding the switch body 106 in position.

As the switch body 106 moves from the first position to the second position, the lip 148 of the retaining arms 108 slides along the contours 128 of the sliding plate 104 as illustrated by the intermediate position in FIG. 3B. As the lip 148 slides along the concave contour 128 of the slide plate 104, the biasing force applied by the conductive springs 136 onto the PCB 102 or the conductive contacts 118 forces the switch body 106 away from the first surface 112 of the PCB 102, thereby causing the conductive springs 136 to become less compressed, as shown in FIG. 3B. For example, as is illustrated in FIG. 3B, the conductive springs 136 have a compressed length Y', which is greater than the compressed length Y of the springs 136 in FIG. 3A. As a result, the forces acting on the first surface 112 of the PCB 102 and the conductive springs 136 are reduced. In one embodiment, the conductive springs 136 may be in an uncompressed state in the position shown in FIG. 3B or anywhere along the contour 128 path.

From the description set forth above, it should be appreciated that as the second end 140 of a conductive spring 136 slides along the first surface 112 of the PCB 102, including along a portion of the conductive contacts 118, the resulting force being applied to the second end 140 is also reduced as the contour 128 path is followed. In that regard, frictional and/or other forces applied to the second end 140 of the conductive spring 136 are also reduced. In some embodiments, this may reduce wear to the second end 140 of the conductive spring 136. Similarly, the frictional and/or other forces applied to the PCB 102 and/or the conductive contacts 118 may be reduced. In some embodiments, this may reduce wear and/or damage incurred by the PCB 102 and/or the conductive contact 118.

When the switch body 106 reaches the second position as illustrated by FIG. 3C, the conductive spring 136 may return to a more compressed state sufficient to place the conductive spring 136 in electrical connection with the conductive contact 118. In the embodiment illustrated in FIG. 3C, the conductive spring 136 is returned to a compressed state so as to have a compressed length Y. As in the position illustrated in FIG. 3A, each compressed conductive spring 136 in the position illustrated in FIG. 3C applies a biasing force to a surface of the corresponding conductive contact 118. Further, as described above, the lip 148 of the retaining arms 108 may be configured to counteract the force applied by the conductive spring 136 thereby holding the switch body 106 in position on the PCB 102.

In an alternative embodiment, the slide plate 104 may be secured to the first surface 112 of the PCB 102. In this alternative embodiment, the slide plate 104 may be provided between the switch body 106 and the PCB 102. In particular, the second surface 124 of the slide plate 104 may be secured to the first surface 112 of the PCB 102, and the inner surface 134 of the switch body 106 may be on or adjacent the first surface 122 of the slide plate 104. In this embodiment, the switch body 106 may be configured to slide along the first surface 122 of the sliding plate 104. However, it will be appreciated that the contours on the first surface 122 of the slide plate 104 may be convex. As such, the convex contour portions reduce the forces applied to the PCB 102 and each conductive spring 136.

In other alternative embodiments, a cam or pivot arm may be utilized to reduce an amount of force applied to the PCB 102 by the conductive springs. That is, the cam or pivot arm may be coupled to the switch body 106 causing the switch body 106 to move away from the first surface 112 of the PCB 102 thereby reducing the amount of force being applied to the surface thereof by the conductive springs 136. In yet another alternative embodiment, the contour 128 on the slide plate 104 may be integral with the first surface 112 or the second surface 114 of the PCB 102.

Figure 4:
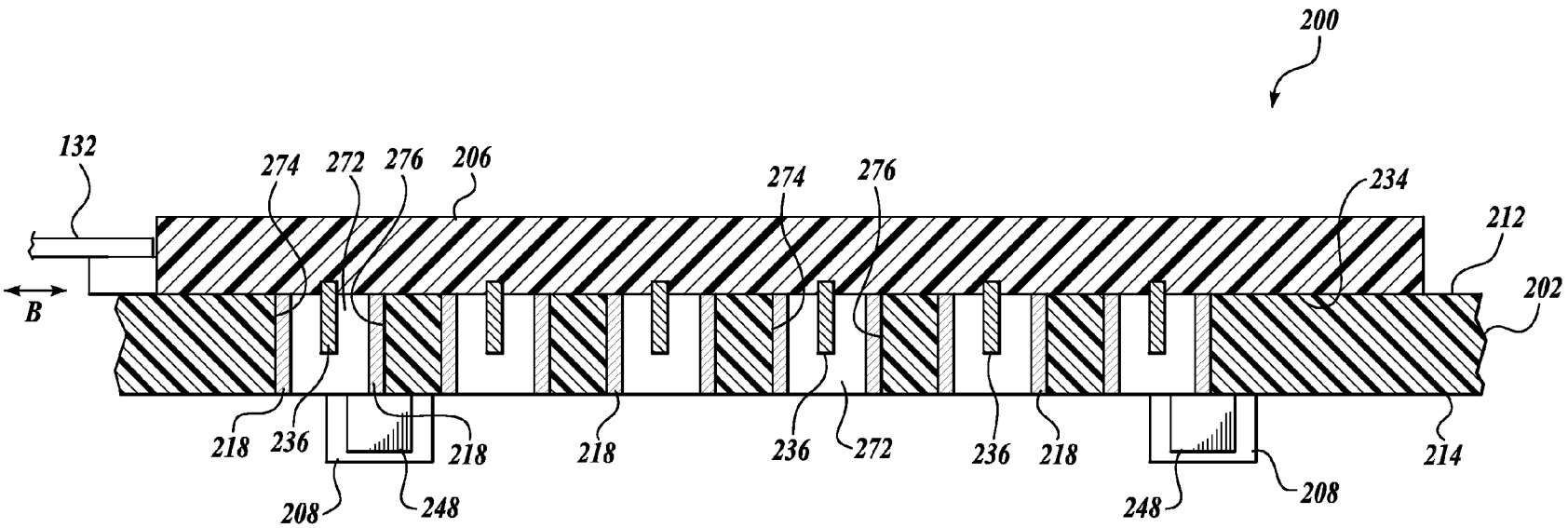
FIG. 4 is a cross-sectional view of another switch assembly in accordance with aspects of the disclosure.

Turning now to FIG. 4, there is shown another exemplary embodiment of a switch assembly 200, formed in accordance with aspects of the present disclosure. The switch assembly 200 is substantially identical in materials and operation to many components of the previously described embodiments. However, the switch assembly 200 differs from the switch assembly 100 in some respects, as will be described in more detail below. For clarity in the ensuing descriptions, numeral references of like elements of the switch assembly 200 are similar to those used to describe the switch assembly 100, but are in the 200 reference numeral series, for the illustrated embodiment.

As best shown in FIG. 4, which is a cross-sectional view of a switch assembly 200 in an intermediate position, the switch assembly 200 includes a PCB 202 and an insulative body, such as a switch body 206. The PCB 202 may be a PCB as described in reference to FIGS. 1-3 and includes a first surface 212 and an opposite, second surface 214. The PCB 202 further includes one or more elongate openings 272 formed therein. The one or more openings 272 may be oriented on the PCB 202 such that a longitudinal axis of the openings 272 is aligned with the direction of motion indicated by arrow B in FIG. 4. Each of the openings 272 includes a first end 274 and a second end 276. Although six openings 272 are depicted in FIG. 4, it is to be understood that any number of openings 272 in any orientation, such as any number of rows, may be provided in the PCB 202. For instance, in one embodiment, the PCB 202 includes ten openings formed therein, with five slots in two rows. As is illustrated in FIG. 4, the one or more openings 272 may extend from the first surface 212 of the PCB 202 to the second surface 214 of the PCB 202, thereby forming elongated slots. In an alternative embodiment, however, the one or more openings 272 may extend from the first surface 212 partially through PCB 202. In this alternative embodiment, the openings 272 form channels, each having a bottom surface not shown in FIG. 4.

The switch assembly 200 further includes pairs of conductive contacts 218, each pair being associated with an opening 272. In the embodiment shown, respective conductive contacts 218 may be formed at each end of the openings 272. That is, a conductive contact 218 may be formed at the first end 274 of each opening 272, and a conductive contact 218 may be formed at the second end 276 of each opening 272. The conductive contacts 218 may be constructed of any material or materials configured to allow electrons to flow therethrough. It will be appreciated that the conductive contacts 218 may be in electrical connection with other components (not shown) on the PCB 202 via traces (not shown) formed within the PCB 202. In one embodiment, the conductive contacts 218 are made of copper and plated with a noble metal, such as gold. In some embodiments, one or more edges of the conductive contacts 218 may be beveled.

Still referring to FIG. 4, the switch assembly 200 includes an insulative body, such as the switch body 206 that carries one or more conductive members 236. The switch body 304 includes a somewhat planar surface 234 that interfaces with the first surface 212. The conductive members 236 may be configured to extend outwardly from the surface 234 of the switch body 206. In particular, a first portion of each of the conductive members 236 may be secured to the switch body 206 such that a second portion of the conductive members 236 extends outwardly from the surface 234 of the switch body 204. In embodiments that include a plurality of conductive members 236, such as the one shown in FIG. 4, the conductive members 236 are positioned so as to be spaced apart from any other conductive member 236. The conductive members 236 are further positioned so as to correspond to the orientation and positioning of the openings 272 in the PCB 202. That is, each of the conductive members 236 are oriented in the switch body 206 to align with a corresponding opening 272 in the PCB 202. The switch body 206 may further include retaining arms 208 secured to or integral formed with the switch body 206 for movably retaining the switch body on the PCB 202.

In embodiments of the present disclosure, the one or more conductive members 236 may be any conductive member configured to electrically connect with a corresponding conductive contact 218 when a portion of the conductive member 236 abuts the conductive contact 218. In one embodiment, the conductive members 236 may be a spring. Non-limiting examples of the conductive members 236 may include a leaf spring, a C-shaped spring, a coil spring, or any spring or member configured to make suitable electrical contact with the conductive contacts 218. In other embodiments, the conductive members are bars, rods, etc. In one embodiment, the conductive members 236 are copper conductive members, which may or may not be plated with a noble metal, such as gold.

When assembled, as illustrated in FIG. 4, the switch body 206 is positioned on the first surface 212 of the PCB 202, such that each of the conductive members 236 is provided within a corresponding opening 272 in the PCB 202. As briefly described above, the switch body 206 may be movably held on the PCB 202 by retaining arms 208. Depending on the location of the switch body 206 on the PCB 202, the retaining arms 208 may extend through openings in the PCB 202 similar to the openings 120 illustrated in FIG. 1, and/or along an outer edge of the PCB 202 as illustrated by FIG. 1. The lip 248 of each of the retaining arms 208 may be provided against the second surface 214 of the PCB 202 to hold the switch body 206 onto the surface of the PCB 202.

In some embodiments of the present disclosure, the switch body 206 may be manually actuated between first and second positions. In other embodiments, an actuator, such as actuator 130 as described in reference to FIG. 1, may be employed to affect movement of the switch body 206 through moving arm 132 from a first position to a second position. That is, the switch assembly 200 may be configured to switch from a first state to a second state when the actuator 130 (FIG. 1) causes the moving arm 132 to move in one of the directions indicated by arrow B.

FIG. 4 illustrates the switch assembly 200 in an intermediate position, such that the conductive members 236 are not in contact with a respective conductive contact 218. As the actuator 130 causes the switch body 206 to move to a first position, i.e. towards the conductive contacts 218 located at the first end 274 of the openings 272, the conductive members 236 move within corresponding openings 272 until the conductive members 236 make physical contact with the conductive contacts 218 at the first end 274 of each opening 272. When the switch assembly 200 is in the first position and a portion of each conductive member 236 is in electrical connection with a corresponding conductive contact 218, the switch assembly 200 is placed in a first state.

Similarly, as the actuator 130 causes the switch body 206 to move to a second position, i.e. towards the conductive contacts 218 located at the second end 276 of the opening 272, the conductive members 236 move within the corresponding openings 272 until the conductive members 236 make physical contact with the conductive contacts 218 at the second end 276 of the opening 272. When the switch assembly 200 is in the second position and a portion of each conductive member 236 is in electrical connection with a corresponding conductive contact 218, the switch assembly 200 is placed in a second state. As will be clear to those skilled in the art, the illustrated switch assembly 200 may be modified for any number of poles. In that regard, any number of slots and any number of conductive contacts may be employed based on the intended purpose of the switch assembly.

Various principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the claimed subject matter.

The embodiments of the disclosure in which an exclusive property or privilege is claimed are defined as follows:

1. A switch assembly comprising:

a substrate having at least one first conductive contact;

a slide plate secured to the substrate, wherein the slide plate includes at least one contour;

at least one conductive component configured to electrically connect with the at least one first conductive contact when the at least one conductive component is in a first position; and an insulative body configured to hold the at least one conductive component, wherein the insulative body is moveable along the at least one contour of the slide plate and configured to move the at least one conductive component from the first position to a second position, and wherein when the at least one conductive component is in the second position the at least one conductive component is disposed a distance away from the first conductive contact.

2. The switch assembly of claim 1, wherein the substrate includes at least one second conductive contact, wherein the at least one conductive component is further configured to electrically connect with the at least one second conductive contact in the second position, and wherein the insulative body is moveable along the at least one contour of the slide plate between the first position and the second position.

3. The switch assembly of claim 2, wherein the substrate is a printed circuit board that includes a first surface and a second surface, wherein the at least one first conductive contact and the at least one second conductive contact are located on the first surface and the slide plate is located on the second surface.

4. The switch assembly of claim 3, wherein the at least one contour is concave.

5. The switch assembly of claim 2, wherein the at least one first conductive contact, the at least one second conductive contact, and the slide plate are located on a first surface of the substrate.

6. The switch assembly of claim 5, wherein the at least one contour is convex.

7. The switch assembly of claim 2, wherein the at least one conductive component comprises a plurality of conductive springs, the switch assembly further comprising a plurality of first conductive contacts and second conductive contacts, wherein each conductive spring is configured to electrically connect with a respective one of the first respective conductive contacts and the second respective conductive contacts.

8. A switch assembly comprising:

a printed circuit board having at least one slot defined transversely in the printed circuit board, wherein the at least one slot has a first transverse side wall and a second transverse side wall;

a first conductive contact provided on the first transverse side wall of the at least one slot; and an insulative body including at least one conductive member that is configured to be positioned within the at least one slot and moveable within the at least one slot to selectively contact the first conductive contact.

9. The switch assembly of claim 8, further comprising a second conductive contact provided on the second transverse side wall of the at least one slot, wherein the second conductive contact is spaced apart from the first conductive contact, and wherein movement of the insulated body is capable of selectively placing the at least one conductive member in electrical connection with the second conductive contact.

10. The switch assembly of claim 9, wherein:

the at least one slot is a plurality of slots, wherein each slot of the plurality of slots includes the first conductive contact provided on the first transverse side wall of the slot and the second conductive contact provided on the second transverse side wall of the slot, wherein the insulative body includes a plurality of conductive members that are each configured to be positioned within a slot of the plurality of slots.

11. The switch assembly of claim 8, wherein the at least one conductive member is a conductive spring.

12. The switch assembly of claim 8, wherein the at least one slot extends from a first surface to a second surface of the printed circuit board.

13. A method of switching an electrical device from a first state to a second state, the method comprising:

compressing at least one conductive spring on a first respective conductive contact to place the electrical device in the first state, the at least one conductive spring being held by an insulative body;

sliding a portion of the insulative body along at least one contour to move the at least one conductive spring from the first respective conductive contact to a second respective conductive contact, wherein sliding the portion of the insulative body along the at least one contour reduces an amount at which the at least one conductive spring is compressed; and compressing the at least one conductive spring on the second respective conductive contact to place the electrical device in the second state.

14. The method of claim 13, wherein the at least one contour is one of concave or convex.

15. The method of claim 13, wherein the first and second conductive contacts are on a first surface of a printed circuit board.

16. The method of claim 13, wherein the at least one conductive spring is selected from a group consisting of a coil spring, a leaf spring, and a C-shaped spring.

17. The method of claim 13, wherein sliding the portion of the insulative body along the at least one contour causes the at least one conductive spring to uncompress to an uncompressed state.

18. A method of switching an electrical device from a first state to a second state, the method comprising:

moving a conductive member of the electrical device to a first position, wherein the conductive member is positioned in a slot formed transversely in a printed circuit board, wherein the slot has a first transverse side wall forming a first end, and wherein the conductive member in the first position electrically couples to a first conductive contact formed at the first end of the slot placing the electrical device in the first state; and moving the conductive member from the first position away from the first conductor contact to a second position placing the electrical device in the second state.

19. The method of claim 18, wherein a second transverse side wall of the slot forms a second end, and wherein the conductive member in the second position electrically couples to a second conductive contact formed at the second end of the slot.

20. The method of claim 19, wherein the conductive member is a conductive spring and the conductive spring decompresses when the conductive spring moves from the first position to the second position.

21. The method of claim 18, wherein the slot extends from a first surface of the printed circuit board to a second surface of the printed circuit board.

22. The method of claim 18, further comprising providing a plurality of conductive members each in a respective slot in the printed circuit board.

23. The method of claim 18, wherein the conductive member does not contact the printed circuit board when moving the conductive member between the first position and the second position.

24. The switch assembly of claim 8, wherein the at least one conductive member does not contact the printed circuit board when the at least one conductive member is moved between the first transverse side wall and the second transverse side wall of the at least one slot.

* * * * *